United States Patent [19]

Reisdorf

[11] 4,185,998

[45] Jan. 29, 1980

[54] STEEL WITH IMPROVED LOW TEMPERATURE TOUGHNESS

[75] Inventor: Bartholomew G. Reisdorf, Pittsburgh, Pa.

[73] Assignee: United States Steel Corporation, Pittsburgh, Pa.

[21] Appl. No.: 967,347

[22] Filed: Dec. 7, 1978

[51] Int. Cl.[2] ..... C22C 38/06; C22C 38/44

[52] U.S. Cl. ..... 75/124; 75/125; 75/128 W; 148/36

[58] Field of Search ..... 148/36; 75/124, 125, 75/128 W

[56] References Cited

U.S. PATENT DOCUMENTS

| | | | |
|---|---|---|---|
| 3,110,586 | 11/1963 | Gulya et al. | 75/124 |
| 3,310,441 | 3/1967 | Mandich | 148/36 |
| 3,592,633 | 7/1971 | Osuka et al. | 75/124 |
| 3,692,514 | 9/1972 | Hydrean | 148/36 |
| 3,834,949 | 9/1974 | Heitmann et al. | 148/36 |
| 3,920,051 | 11/1975 | Bell et al. | 75/125 |
| 3,955,971 | 5/1976 | Reisdorf | 148/36 |
| 4,025,368 | 5/1977 | Sanbongi et al. | 148/36 |
| 4,043,807 | 8/1977 | Kirman | 148/36 |

FOREIGN PATENT DOCUMENTS

| | | | |
|---|---|---|---|
| 1254871 | 11/1967 | Fed. Rep. of Germany | 148/36 |
| 763398 | 12/1956 | United Kingdom | 148/36 |
| 1020572 | 2/1966 | United Kingdom | 148/36 |

*Primary Examiner*—Arthur J. Steiner
*Attorney, Agent, or Firm*—Arthur J. Greif

[57] ABSTRACT

Steel compositions which provide a combination of high-strength with good low-temperature toughness, are made more economical to produce by the addition of small amounts of copper, molybdenum and chromium to reduce the amount of nickel required for such properties. For steels containing less than 1.5% nickel, low temperature toughness can further be improved without any sacrifice in strength by maintaining the silicon content below 0.1%, and preferably below 0.05%.

5 Claims, No Drawings

STEEL WITH IMPROVED LOW TEMPERATURE TOUGHNESS

Steels intended for low temperature service which required a combination of good strength and low temperature toughness normally depended upon the addition of expensive alloying elements, e.g. 3 to 9% nickel, to provide such low temperature properties. Recently, it has been discovered that for many such applications, more economical steels could be employed which rely on the use of various alloying elements such as columbium and vanadium (U.S. Pat. No. 3,834,949) to reduce the dependence on nickel to within the range of 2 to 3%. Further economies are achieved in reducing the normally requisite nickel content to below a value of 1.5% by the substitution therefor of elements such as copper, chromium and molybdenum. Examples of the latter developments are shown in U.S. Pat. Nos. 3,692,514 and 3,955,971, the disclosures of which are incorporated herein by reference. The latter steels, as a result of their lower cost and good combination of properties, have gained wide commercial acceptance.

It has now been found that the low temperature properties of such steels can further be improved without any sacrifice either in (a) the strength of such steels or (b) the economy of production, by limiting the silicon content thereof to a value less than 0.1%. As a result of the improvement in toughness achieved by this finding, the art is provided with alternative advantages which (i) permit such steels to be used at even lower temperatures or (ii) provide further economies in decreasing the requisite amount of other alloying elements, for example, by aiming the nickel content at the low side of the range. Conventional steel compositions intended for arctic service are normally utilized in the killed condition, i.e. utilizing sufficient aluminum to effect such killing. Silicon is employed in conjunction with aluminum for such killing, but has been used in such steels to increase the yield strength thereof, at concentrations below which the impact resistance would deteriorate, i.e. concentrations below 0.4%. The silicon content of such steels when supplied for commercial applications is normally within the range of 0.2 to 0.3%. Thus, when the low alloy, low nickel content steels were developed (i.e. those of U.S. Pat. Nos. 3,692,514 and 3,955,971) it was assumed that the behavior of silicon would be similar to that of such conventional low temperature steels and similar silicon ranges were therefore employed. It has now been discovered that the effect of silicon is quite different in the latter steels, (i.e. those in which chromium, copper and molybdenum are employed to reduce the dependence upon nickel to a value below 1.5%), in that silicon provides no increase in strength, while its use therein is quite detrimental to low temperature properties. These detrimental effects of silicon are shown in the table below for one such exemplary composition. Five-inch ingots were hot-rolled to a thickness of 2.64", cut into lengths, reheated to 2300° F., transverse rolled to 1"-thick plate, and air-cooled. Thereafter, the plate was austenitized by reheating 1650° F., water quenched and tempered for one hour at 1150° F.

TABLE

| Ex. No. | C | Mn | Cu | Ni | Cr | Mo | Al | N | Si | Yield Str. ksi | 50% Shear Fracture Appear. (Trans.-Direct.) °F. |
|---|---|---|---|---|---|---|---|---|---|---|---|
| 1 | .093 | .62 | .003 | 1.00 | 1.02 | .30 | .026 | .006 | .02 | 73.3 | −160 |
| 2 | .091 | .61 | .005 | .98 | 1.00 | .30 | .026 | .006 | .056 | 74.2 | −140 |
| 3 | .090 | .62 | .003 | .98 | 1.01 | .30 | .026 | .007 | .084 | 73.6 | −140 |
| 4 | .084 | .62 | .003 | .99 | 1.01 | .30 | .023 | .006 | .10 | 77.2 | −140 |
| 5 | .085 | .58 | .006 | 1.01 | 1.04 | .31 | .026 | .007 | .24 | 73.5 | −90 |

As seen from the results above, Ex. 5 containing a normal range of Si, i.e. 0.24%, exhibited a ductile-to-brittle transition temperature (based on the appearance of 50% brittle fracture) of −90° F.; the range, as shown in the '971 patent, for steels similarly treated and tested varying from −30° to −110° F., depending on the concentration of other elements. By contrast, Inventive Examples 1 through 4 employed virtually the same composition as that utilized in Example 5, except that the Si level was not greater than 0.10%. These latter, inventive steels provided (a) transition temperatures of −140° to −160° F., in combination with (b) strengths equal to or greater than that of the conventional steel, Example 5.

As shown by the two incorporated patents, the steels to which this invention relates may contain: (i) from 0.02 to 0.12% C. in which at least 0.06% C. will be employed to achieve more desirable strength levels; (ii) 0.20 to 1.0% Mn; (iii) 0.6 to 1.5% Ni; (iv) 0.3 to 1.4% Cr, (v) 0.1 to 0.9% Mo; preferably 0.15 to 0.40%; (vi) up to 1.5% Cu. It is desirable that the sum of Cu+Cr not be greater than 1.5%, and in some applications that Cu be less than 0.2%. In accord with this invention, Si should be maintained at a level equal to or below 0.10%. To insure superior low temperature properties it is preferable that Si be below 0.05%.

I claim:

1. In a steel product having a composition consisting essentially of 0.02 to 0.12% C, 0.20 to 1.0% Mn, 0.6 to 1.5% Ni, 0.3 to 1.4% Cr, 0.1 to 0.9% Mo, up to 1.5% Cu, Al in an amount at least sufficient to kill said steel, balance Fe, said product having a yield strength in excess of 60 ksi and a Charpy v-notch energy absorption at −80° F. of at least 50 ft-lb in both the longitudinal and transverse directions, the improvement for enhancing low-temperature toughness with no sacrifice in yield strength by maintaining the Si content of said composition at a level equal to or below 0.10%.

2. A steel product of claim 1, wherein said product is a plate having been cooled from the austenite range and thereafter tempered.

3. The plate of claim 2, in which C is at least 0.06%, Mo is within the range 0.15 to 0.40%, and the sum of Cu+Cr does not exceed 1.5%.

4. The plate of claim 3, in which Cu is less than 0.2%.

5. The plate of claims 3 or 4, in which Si is maintained at a level below 0.05%.

* * * * *